US005584353A

United States Patent [19]

Chancey et al.

[11] Patent Number: 5,584,353

[45] Date of Patent: Dec. 17, 1996

[54] WELL JAR ACCELERATOR WITH EXPANSION CHAMBER

[75] Inventors: Roger D. Chancey, Humble; Archie W. Peil, Houston; Wayne A. Kovar, Rosenberg, all of Tex.

[73] Assignee: Bowen Tools, Inc., Houston, Tex.

[21] Appl. No.: 398,755

[22] Filed: Mar. 6, 1995

[51] Int. Cl.[6] ..... E21B 4/14

[52] U.S. Cl. ..... 175/297; 166/178

[58] Field of Search ..... 175/296, 297; 166/178, 301

[56] References Cited

U.S. PATENT DOCUMENTS

| | | | |
|---|---|---|---|
| 3,570,612 | 3/1971 | Slator | 175/297 |
| 3,606,297 | 9/1971 | Webb | 267/125 |
| 3,735,828 | 5/1973 | Berryman | 175/299 |
| 3,898,815 | 8/1975 | Young | 175/297 X |
| 3,955,634 | 5/1976 | Slator et al. | 175/297 |
| 3,987,858 | 10/1976 | Slator et al. | 175/297 |
| 4,023,630 | 5/1977 | Perkin et al. | 175/297 |
| 4,210,214 | 7/1980 | Blanton | 175/297 |
| 4,331,006 | 5/1982 | Bishop | 464/18 |
| 4,439,167 | 3/1984 | Bishop et al. | 464/20 |
| 4,844,183 | 7/1989 | Evans | 175/296 |
| 5,033,557 | 7/1991 | Askew | 166/178 X |
| 5,069,282 | 12/1991 | Taylor | 166/178 X |
| 5,232,060 | 8/1993 | Evans | 166/178 X |

OTHER PUBLICATIONS

"Instruction Manual Bowen Jar Intensifiers," Manual No. 5/4019, Bowen Tools, Inc., Jul. 1984.

"Bumper sub, jar accelerator, combination drilling jar," DES/Griffith, *Classified Index of Products & Services in the 37th (1986–87) Revision of Composite Catalog*, p. 1693.

"H–E Accelerator," Houston Engineers, Inc, *Classified Index of Products & Services in the 37th (1986–87) Revision of Composite Catalog*, pp. 2704–2705.

*Primary Examiner*—William P. Neuder

*Attorney, Agent, or Firm*—Pravel, Hewitt, Kimball & Krieger

[57] ABSTRACT

A hydraulic well jar accelerator used in a fishing string in conjunction with a well jar. The well jar accelerator includes inner and outer cylindrical assemblies movable longitudinally relative to each other and having an annular space between the cylindrical assemblies. An annular seal and an expansion sleeve disposed between the cylindrical assemblies are longitudinally spaced relative one another to form an annular liquid chamber in the annular space. The annular liquid chamber confines a hydraulic operating fluid. The volume of the annular liquid chamber can be adjusted by spring-loading the expansion sleeve without relative longitudinal movement of the inner and outer assemblies. The annular liquid chamber is operatively segregated into a main liquid chamber and an expansion liquid chamber. An annular seal body and an annular piston are disposed between the cylindrical assemblies in the annular liquid chamber. The seal body is attached to one of the cylindrical assemblies and has a first end surface. The piston has a first end surface capable of contacting the first end surface of the seal body such that the first and second liquid chambers are in non-fluid communication with each other.

26 Claims, 4 Drawing Sheets

FIG. 4
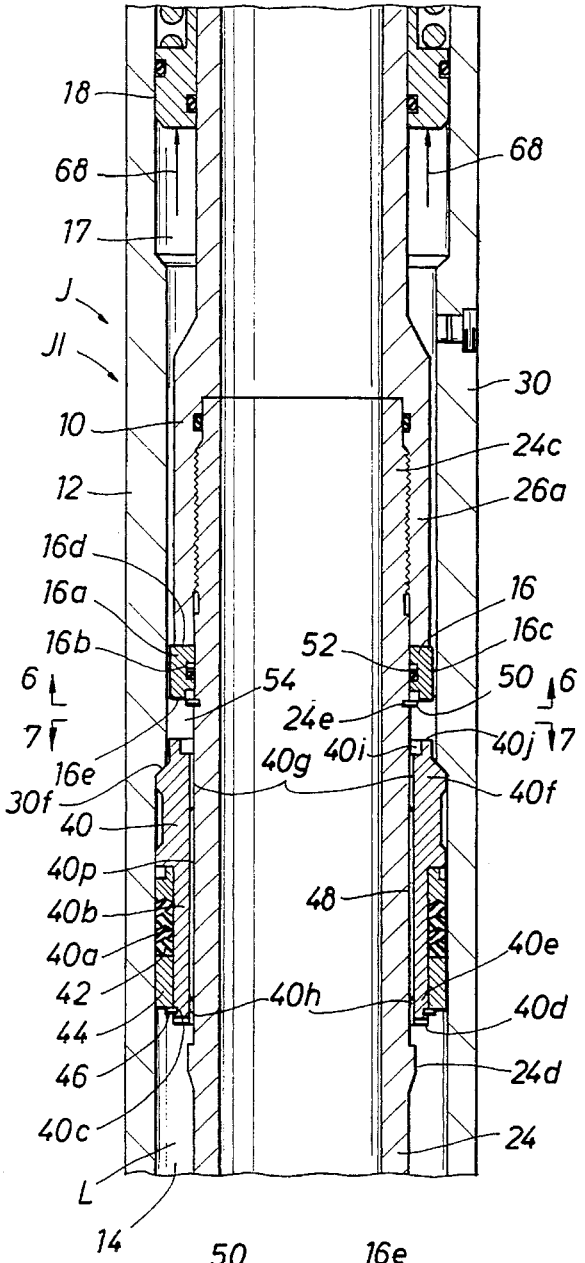
FIG. 5
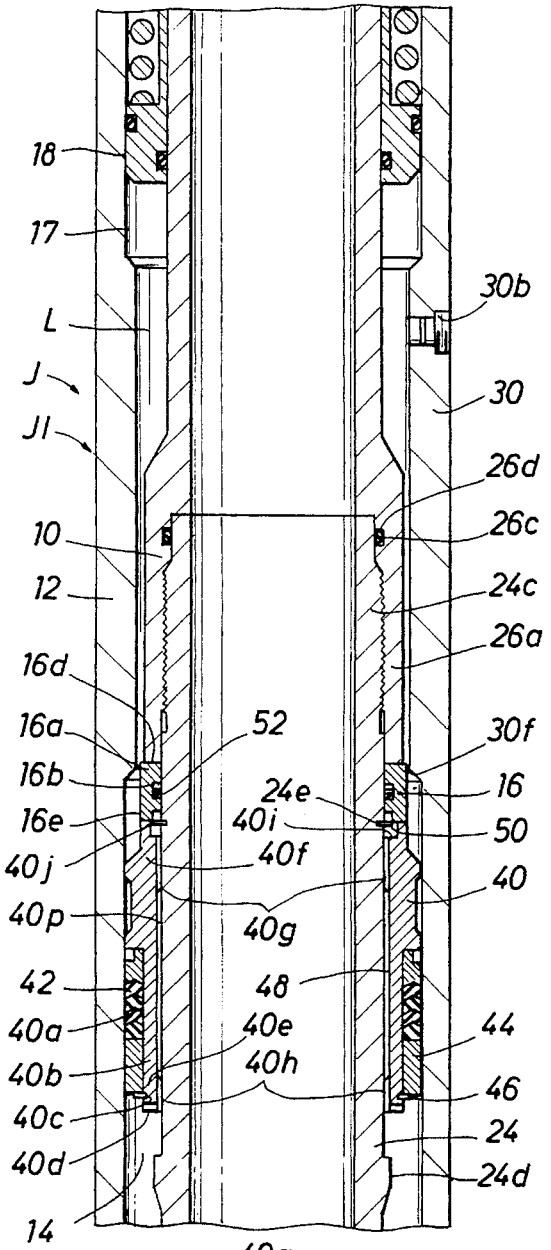
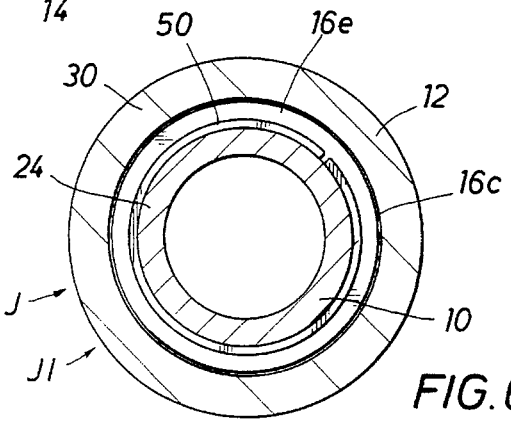
FIG. 6
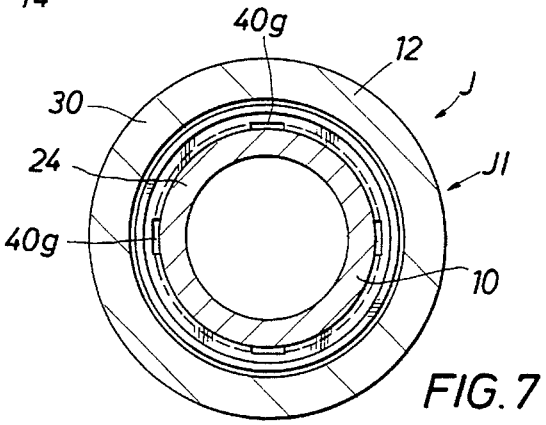
FIG. 7

WELL JAR ACCELERATOR WITH EXPANSION CHAMBER

BACKGROUND OF THE INVENTION

1. Field of the Invention

The present invention relates to well jar accelerators used in conjunction with well jars for applying a jarring blow to stuck tubing, drill pipe or other stuck objects or tools in drilling and fishing operations in a well.

2. Description of the Prior Art

A well jar accelerator is designed to be used in conjunction with a well jar in a bottom hole assembly of a fishing string in a well. As used herein, fishing string will be used to include the entire string from the ground or surface level down to the fishing tool at the lowermost end of the fishing string. The fishing string is made up of a running string and a bottom hole assembly which is located below the running string. The bottom hole assembly is typically made up of the well jar accelerator located above a concentrated mass which is located above the well jar. A fishing tool is connected to the lower end of the bottom hole assembly.

The well jar is a percussion tool that operates on a mechanical or hydraulic principle and is designed to deliver a heavy hammer blow to an object stuck in the well. Well jars are often designed to permit blows to be delivered in either an upward ("up" well jar) or downward ("down" well jar) direction. Well jars are used to impart a jarring motion to stuck tubing, drill pipe or other stuck objects or tools in drilling and fishing operations for the purpose of freeing them.

Typically, well jars are constructed with inner and outer telescopically arranged cylindrical assemblies movable longitudinally relative to each other. The cylindrical assemblies have spline portions which are always engaged with each other. This enables the well jar to transmit torque in either direction at all times and in any position of the well jar stroke. The well jars have a delay mechanism, either mechanical or hydraulic, that severely restricts the relative longitudinal movement of the inner and outer cylindrical assemblies when an axial load is first applied. This results in the development of tension or compression in the running string, depending upon the particular well jar's construction and direction of relative movement, i.e., upward or downward. As soon as the delay mechanism releases, the relative movement of the cylindrical assemblies is unrestricted and the cylindrical assemblies are free to move suddenly to the limits of their relative movement to produce a jarring blow to free the stuck object. Examples of well jars of this type and the operation thereof may be found in U.S. Pat. Nos. 3,987,858 and 3,955,634.

During conventional up jarring and down jarring operations with well jars, the intensity of the blow struck is a function of, and proportional to, the accelerated rapid movement of the concentrated mass located immediately above the well jar, with the energy derived from the stretch of the entire running string above the "up" well jar or from the applied weight above the "down" well jar. This accelerated movement of the concentrated mass is often considerably diminished by friction of the running string against the wall of the well. In such cases, much of the energy of the running string is not delivered to accelerate the concentrated mass but is lost to friction. Also, at very shallow depths when jarring either up or down, the lack of available stretch or compression in the short running string causes a great loss in the effective acceleration, greatly reducing the intensity of the blow. If the stretch or compression is very small, the well jar may not impact at all.

A fluid-type well jar accelerator is made up in the fishing string above the well jar with a concentrated mass being located between the well jar and the well jar accelerator. The well jar accelerator increases the magnitude of the delivered jarring blow of the well jar. The well jar accelerator functions as a hydraulic fluid spring which stores energy in a fluid chamber when a strain is applied to the running string. This stored energy is in addition to the energy of the "stretched" or "compressed" running string. When the strain is released by the free stroke (jarring) of the well jar, the stored energy in the well jar accelerator is released. The stored energy accelerates the well jar and concentrated mass either upwards or downwards (depending on the jarring operations) until a blow of high impact is struck.

Typically, the well jar accelerator is constructed with inner and outer telescopically arranged cylindrical assemblies movable longitudinally relative to each other and forming between them a liquid chamber confining an operating liquid. The cylindrical assemblies have spline portions which are always engaged with each other. This allows the well jar accelerator to transmit torque in either direction at all times and in any position of the well jar accelerator stroke. Disposed within-the liquid chamber is a piston assembly. Typically, the piston assembly includes seal means to form a seal with the inner cylindrical assembly and a sliding seal with the outer cylindrical assembly on "up" well jar accelerators and vice versa on "down" well jar accelerators.

During jarring operation of the well jar accelerator in combination with the well jar, the well jar accelerator cylindrical assemblies are moved longitudinally relative to each other, causing the piston assembly to compress the liquid in the liquid chamber storing energy. When the well jar delay mechanism releases and the well jar free strokes, the sudden release of stored energy in the well jar accelerator accelerates the concentrated mass between the well jar and the well jar accelerator at tremendous and intensifying velocity. When the well jar reaches its maximum travel, a blow of higher impact is delivered directly to the stuck object due to the additional stored energy of the well jar accelerator. The action is essentially independent of the running string although the stored elastic energy in the running string can also contribute to the intensity of the delivered blow in deep straight wells. In shallow, deviated, or directional wells, the well jar accelerator is often the main, if not only, source of energy for the jarring operation. The well jar accelerator serves to provide the primary acceleration to the concentrated mass, and does not rely on movement of the entire running string. The well jar accelerator directs the impact of the well jar and concentrated mass to the stuck object, where it is most effective and least damaging to the rest of the fishing string, regardless of depth.

Typically, fluid-type well jar accelerators are hydrostatically balanced so that hydrostatic pressure tends to neither open or close the well jar accelerator. Fluid-type well jar accelerators are prone to over-pressure in the liquid chamber due to thermal expansion of the liquid. Presently, well jar accelerators have no thermal expansion compensation mechanism, and as a result, the increased pressure in the liquid chamber of the well jar accelerator reduces the effectiveness of the jarring operation. The pressure from the thermal expansion of the liquid is added to the pressure generated by operating the well jar accelerator. If a pull in excess of the rating of the well jar accelerator is applied, these combined pressures can reach excessive levels and cause a material or seal failure of the well jar accelerator.

It is desirable to have a well jar accelerator including a thermal expansion compensation mechanism for the liquid in the liquid chamber. It is also desirable to have a well jar accelerator which eliminates the possibility of over-pressurization in the liquid chamber so as not to detrimentally affect the jarring operation or jeopardize the integrity of the well jar accelerator. It is further desirable to have a well jar accelerator having an expansion liquid chamber which replenishes lost operating liquid in a main liquid chamber resulting from minor leakage and maintains the appropriate operating volume and liquid pressure in the main liquid chamber. Additionally, it may also be desirable to have a well jar accelerator with a hydrostatic pressure load imbalance to compensate for the weight of the concentrated mass located below the well jar accelerator.

SUMMARY OF THE PRESENT INVENTION

Briefly, the present invention is a well jar accelerator having a thermal expansion compensation mechanism which compensates for thermal expansion of the liquid in a main liquid chamber and eliminates the possibility of over-pressurization in the main liquid chamber so as not to detrimentally affect the jarring operation or jeopardize the integrity of the well jar accelerator. The present invention replenishes lost operating liquid in the main liquid chamber resulting from minor leakage and maintains the appropriate operating volume in the main liquid chamber. Additionally, the present invention can have a hydrostatic pressure load imbalance to compensate for the weight of a concentrated mass located below the well jar accelerator.

The well jar accelerator includes inner and outer telescopically related cylindrical assemblies movable longitudinally relative to each other. Longitudinal spline portions are provided on the cylindrical assemblies. The longitudinal spline portions slidably engage each other in interlocking fit to prevent relative rotational movement. The longitudinal spline portions allow transmission of torque and rotation while permitting relative longitudinal movement between the cylindrical assemblies.

An annular sealing means and an expansion sleeve are disposed between the cylindrical assemblies and are longitudinally spaced relative to one another to form an annular liquid chamber between the cylindrical assemblies. The annular liquid chamber confines a compressible hydraulic operating liquid. The annular liquid chamber, also referred to as a combined liquid chamber, comprises a main liquid chamber and an expansion liquid chamber. The expansion liquid chamber in conjunction with an expansion spring chamber compensates for thermal expansion of the liquid in the main liquid chamber and eliminates the possibility of over-pressurization in the main liquid chamber. The expansion liquid chamber is capable of receiving expanded liquid from the main liquid chamber.

An annular seal body is disposed between the cylindrical assemblies in the combined liquid chamber. The seal body is attached to one of the cylindrical assemblies and has a first end surface. An annular piston is disposed between the cylindrical assemblies in the combined liquid chamber. The piston has a first end surface capable of contacting the first end surface of the seal body. When the first end surfaces contact each other, the main and expansion liquid chambers are in non-fluid communication with each other. The piston and seal body assembly allows fluid communication between the expansion liquid chamber and the main liquid chamber when the well jar accelerator is in an unloaded position, thereby maintaining a constant volume in the main liquid chamber and eliminating the possibility of over-pressurization in the main liquid chamber.

As indicated above, the well jar accelerator includes means for adjusting the volume of the combined liquid chamber without relative longitudinal movement of the inner and outer cylindrical assemblies. The expansion sleeve disposed between the inner and outer cylindrical assemblies includes an internal seal disposed between the expansion sleeve and the inner cylindrical assembly and an external seal disposed between the expansion sleeve and the outer cylindrical assembly.

A spring has a first end bearing against a stop face of the outer cylindrical assembly and a second end bearing against the expansion sleeve. The expansion sleeve is capable of sliding longitudinally in the expansion spring chamber formed in an annular space between the inner and outer cylindrical assemblies with the spring providing resistance in the direction of the stop face. The spring chamber is separated from the combined liquid chamber by the expansion sleeve.

The spring-loaded expansion sleeve acts against the liquid in the expansion liquid chamber to replenish liquid in the main liquid chamber in the event of minor leakage.

BRIEF DESCRIPTION OF THE DRAWINGS

In order to more fully understand the drawings referred to in the detailed description of the present invention, a brief description of each drawing is presented, in which:

FIG. 4 is a detailed fragmentary vertical sectional view showing the piston assembly disposed in position for the upstroke with the main liquid chamber and the expansion liquid chamber in liquid communication with one another and the liquid pressure expanding the expansion liquid chamber;

FIG. 5 is a view similar to FIG. 4 showing the piston assembly traveling upward slightly and the main liquid chamber sealed from the expansion liquid chamber;

FIG. 6 is a cross-sectional view taken along line 6—6 of FIG. 4; and FIG. 7 is a cross-sectional view taken along line 7—7 of FIG. 4.

DETAILED DESCRIPTION OF THE INVENTION

Figure 1:
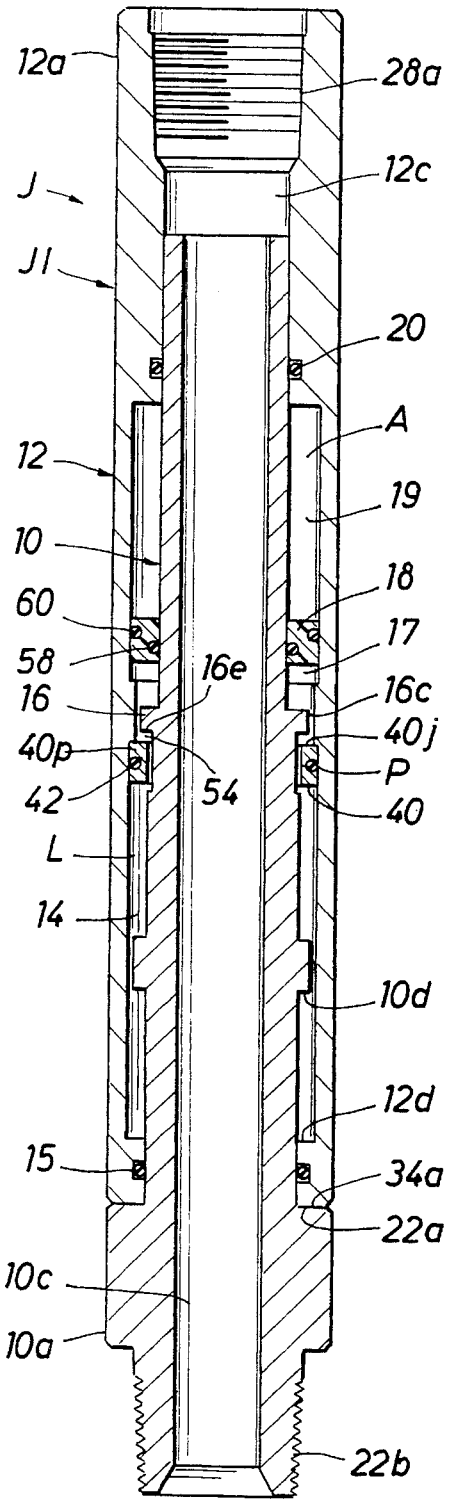
FIG. 1 is a schematic diagram in vertical sectional view of a first embodiment of the present invention illustrating an "up" well jar accelerator.

Referring now to the drawings in greater detail, the well jar accelerator of the present invention is generally designated by the letter J. A first embodiment of the well jar accelerator J is an "up" well jar accelerator, generally designated as J1, as shown in FIGS. 1 and 3–7. A second embodiment of the well jar accelerator J is a "down" well jar accelerator, generally designated as J2, as shown in FIG. 2. It is to be understood that although the following detailed description is primarily described with reference to the "up" well jar accelerator J1, the same features and principles are generally applicable to the "down" well jar accelerator J2 as described below.

It is to be understood that the well jar accelerator J of the present invention can be used in various fishing operations, as for example when a drill string or a pipe string is stuck. To further clarify the terminology, fishing, as used herein, refers to attempting to remove a stuck object or fish from a well. Fish, as used herein, refers to any object in the well that is stuck and is being jarred to free it. Fishing string, as used herein, refers to a running string which is connected to a bottom hole assembly which is connected to a fishing tool. Typically, the running string is comprised of a string of either pipe, tubing, sucker rods or wire line. Typically, the bottom hole assembly is comprised of the well jar accelerator J, a concentrated mass, and the well jar, which may be either a mechanical or hydraulic well jar. The concentrated mass typically includes items such as drill collars, heavy weight or sinker bars. The invention will be described generally in conjunction with reference to a fishing string although it is to be understood that the exact make-up of the fishing string may be comprised of various components which are well known in the art depending on the type of fishing operation required.

Figure 2:
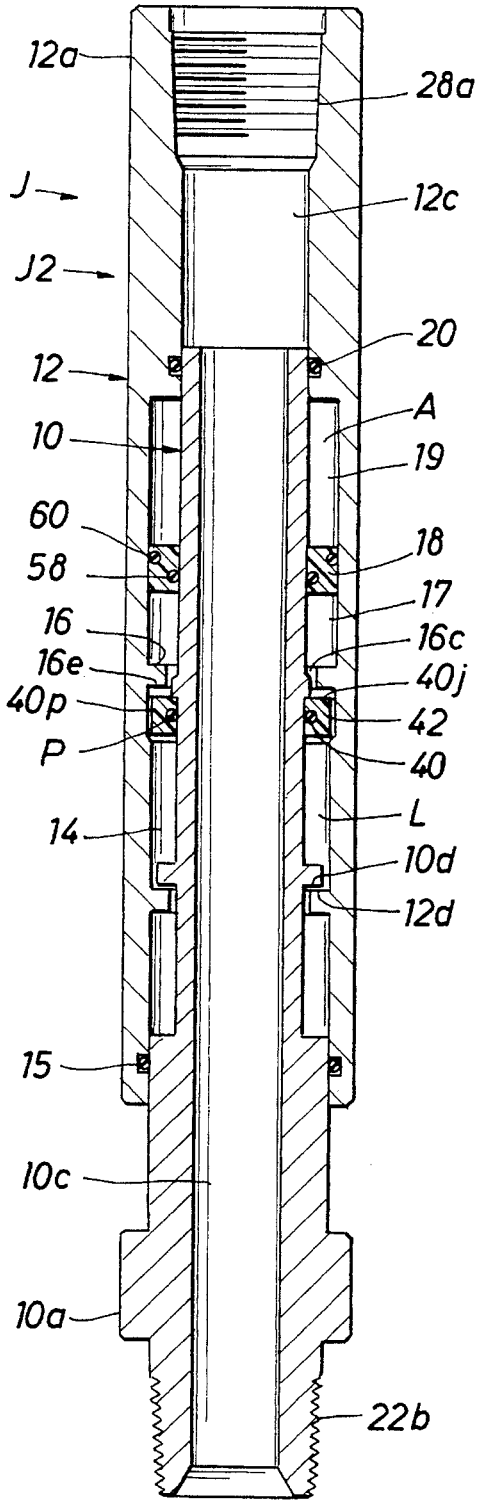
FIG. 2 is a schematic diagram in vertical sectional view of a second embodiment of the present invention illustrating a "down" well jar accelerator.

The well jar accelerators J1 and J2 are schematically illustrated in FIGS. 1 and 2. Each well jar accelerator J1 and J2 comprises inner and outer telescopically arranged cylindrical assemblies indicated generally as 10 and 12, respectively. The outer cylindrical assembly 12 includes a longitudinal bore 12*c*. The telescopically arranged cylindrical assemblies 10 and 12 are movable longitudinally relative to each other and form between them an annular space A. As shown in FIGS. 1 and 2, the inner cylindrical assembly 10 includes a longitudinal bore 10*c*. It is to be understood that the inner cylindrical assembly 10 may not include a longitudinal bore in some instances where it is not necessary to pass a fluid or tool through the well jar accelerator J.

Figure 3A:
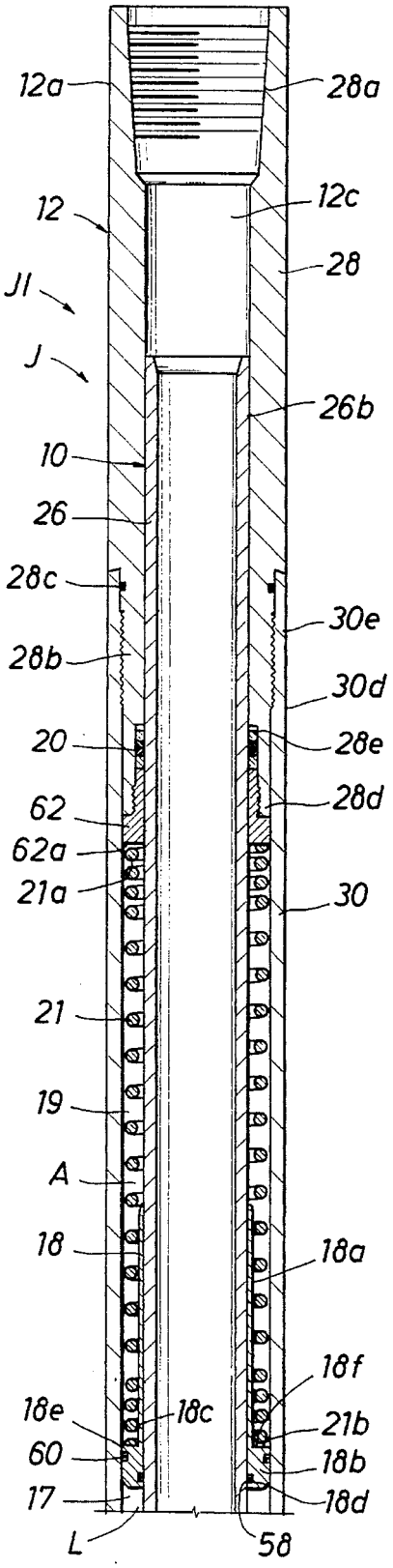
FIGS. 3A, 3B, 3C, and 3D are detailed fragmentary vertical sectional views of the "up" well jar accelerator of the first embodiment of the present invention from the upper portion to the lower portion thereof and showing the main liquid chamber, the expansion liquid chamber, and the piston assembly all disposed in position for the upstroke.
Figure 3B:
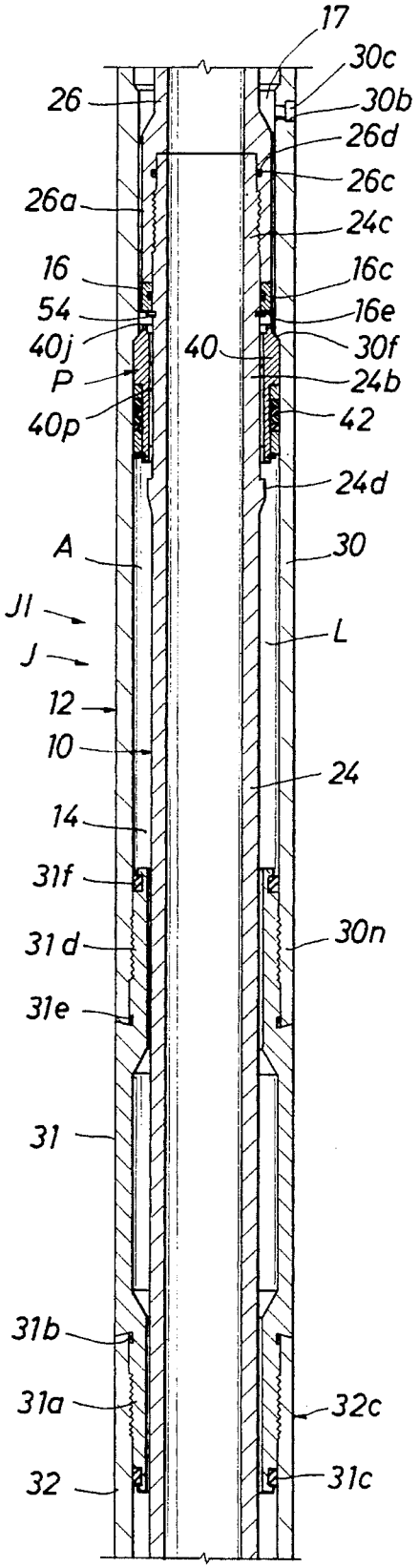

Referring to FIGS. 1, 2 and 3A, the outer cylindrical assembly 12 has an upper end 12*a* which is threaded or otherwise adapted for connection with the fishing string (not shown) which normally extends downwardly into a well for the lowering, raising, and operation of the well jar accelerator J in conjunction with a well jar (not shown). Referring to FIGS. 1, 2 and 3D, the inner cylindrical assembly 10 has a lower end 10*a* which is threaded or otherwise adapted for connection with a lower portion of the bottom hole assembly including a concentrated mass and the well jar. Preferably, the well jar accelerator J should be located in the bottom hole assembly immediately above the concentrated mass (not shown) and the well jar (not shown).

Referring to FIGS. 1, 2 and 3B–3D, a main liquid or hydraulic chamber 14 is provided in the annular space A between the inner and outer cylindrical assemblies 10, 12. The main liquid chamber 14 is defined by a lower seal means 15 (FIGS. 1, 2 and 3D) and a seal body 16 (FIGS. 1, 2 and 3B) spaced longitudinally relative to each other. Referring to FIGS. 1, 2 and 3D, the lower seal means 15 is disposed between the inner and outer cylindrical assemblies 10, 12 in a fluid sealing arrangement. The main liquid chamber 14 contains a hydraulic fluid, preferably a synthetic silicone liquid which is slightly more compressible than standard hydraulic oil. Preferably, the synthetic silicone liquid is in the range of approximately 8–12% compressible.

Referring primarily to FIGS. 1 and 2, an annular expansion liquid chamber 17 is also provided in the annular space A between the inner and outer cylindrical assemblies 10, 12 and adjacently positioned above the main liquid chamber 14. The expansion liquid chamber 17 is defined by the seal body 16 and an expansion sleeve 18 disposed between the inner and outer cylindrical assemblies 10, 12 in sealing engagement therewith and movably spaced longitudinally relative to each other. As more particularly described hereinafter, the expansion liquid chamber 17 is capable of being in fluid communication with the main liquid chamber 14 during one stage of operation while being sealed off from or in non-fluid communication with the main liquid chamber 14 during another stage of operation of the well jar accelerator J. The expansion liquid chamber 17 contains the same fluid as the main liquid chamber 14. The combined expansion liquid chamber 17 and the main liquid chamber 14 will be referred to as the combined liquid chamber L.

Referring to FIGS. 1, 2 and 3A, an annular expansion spring chamber 19 is provided in the annular space A between the inner and outer cylindrical assemblies 10, 12. The expansion spring chamber 19 is separate from the combined liquid chamber L and is adjacently positioned above the expansion liquid chamber 17. The expansion spring chamber 19 is defined by the expansion sleeve 18 and an upper seal means 20 disposed between the inner and outer cylindrical assemblies 10, 12 in sealing engagement therewith. Preferably, as shown in FIG. 3A, the expansion spring chamber 19 contains air and a spring means 21 as will be described in more detail below.

Referring to FIGS. 1 and 2, a piston assembly P including an annular piston 40 is mounted on the inner cylindrical assembly 10 at the upper end of the main liquid chamber 14. The annular piston 40 is allowed limited longitudinal movement relative to the inner cylindrical assembly 10.

Referring to FIG. 1, the annular piston 40 includes a piston seal means 42 forming a slidably engaging fluid-tight seal between the outer cylindrical assembly 12 and the annular piston 40 in the "up" well jar accelerator J1. With reference to FIG. 1, the annular piston 40 has an inner diameter such that a sliding fit is obtained with the opposing surface of the inner cylindrical assembly 10. The annular piston 40 includes one or more passageways 40*p* which permit fluid communication from the main liquid chamber 14 below the annular piston 40 through to the upper end of the annular piston 40. The seal body 16 includes one or more passageways 16*c* which permit fluid communication from above the seal body 16 to below the seal body 16. As shown in FIG. 1, the seal body 16 has an outer diameter slightly less than the inner diameter of the opposing surface of the outer cylindrical assembly 12 so as to form the annular passageway 16*c* therebetween. As shown in FIG. 1, the passageways 40*p* of the annular piston 40 and the seal body passageway 16*c* do not vertically intersect with one another for reasons which will be explained below.

The configuration of the annular piston 40 and the seal body 16 is slightly different for the "down" well jar accelerator J2. As shown in FIG. 2, the piston seal means 42 forms a slidably engaging fluid-tight seal between the inner cylindrical assembly 10 and the annular piston 40 in the "down" well jar accelerator J2. With reference to FIG. 2, the annular piston 40 has an outer diameter such that a sliding fit is obtained with the opposing surface of the outer cylindrical assembly 12. The annular piston 40 includes one or more passageways 40*p* which permit fluid communication from the main liquid chamber 14 below the annular piston 40 through to the upper end of the annular piston 40. In the "down" well jar accelerator J2, the seal body 16 has an inner diameter slightly greater than the outer diameter of the opposing surface of the inner cylindrical assembly 10 so as to form an annular passageway 16*c* therebetween as shown in FIG. 2. As shown in FIG. 2, the passageways 40*p* of the annular piston 40 and the seal body passageway 16*c* do not vertically intersect with one another for reasons which will be explained below.

It is to be understood that the present invention is not limited to the piston and seal body configurations as described above and that various other configurations of the piston and seal body configurations are contemplated and within the scope of the present invention.

As shown in FIGS. 1 and 2, the annular piston 40 has an upper face 40*j* for sealingly contacting a lower surface 16*e* of the seal body 16 during one stage of operation of the well jar accelerator J. For example, when the "up" well jar accelerator J1 of FIG. 1 is put in tension by pulling up on the outer cylindrical assembly 12 with the inner cylindrical assembly 10 indirectly connected to a lower stuck object, the piston assembly P rises with the outer cylindrical assembly 12 until the upper face 40*j* of the annular piston 40 sealingly contacts the lower surface 16*e* of the seal body 16. The lower surface 16*e* of the seal body 16 seals off the open passageways 40*p* at the upper face 40*j*. At this point the main liquid chamber 14 is in non-fluid communication with the expansion liquid chamber 17 for reasons which will be explained below.

Similarly, when the "down" well jar accelerator J2 of FIG. 2 is put in compression by pushing down on the outer cylindrical assembly 12 with the inner cylindrical assembly 10 indirectly connected to a lower stuck object, the seal body 16 lowers with the outer cylindrical assembly 12 until the lower surface 16*e* of the seal body 16 sealingly contacts the upper face 40*j* of the annular piston 40. The lower surface 16*e* of the seal body 16 seals off the open passageways 40*p* at the upper face 40*j*. At this point the main liquid chamber 14 is in non-fluid communication with the expansion liquid chamber 17 for reasons which will be explained below.

Figure 3C:
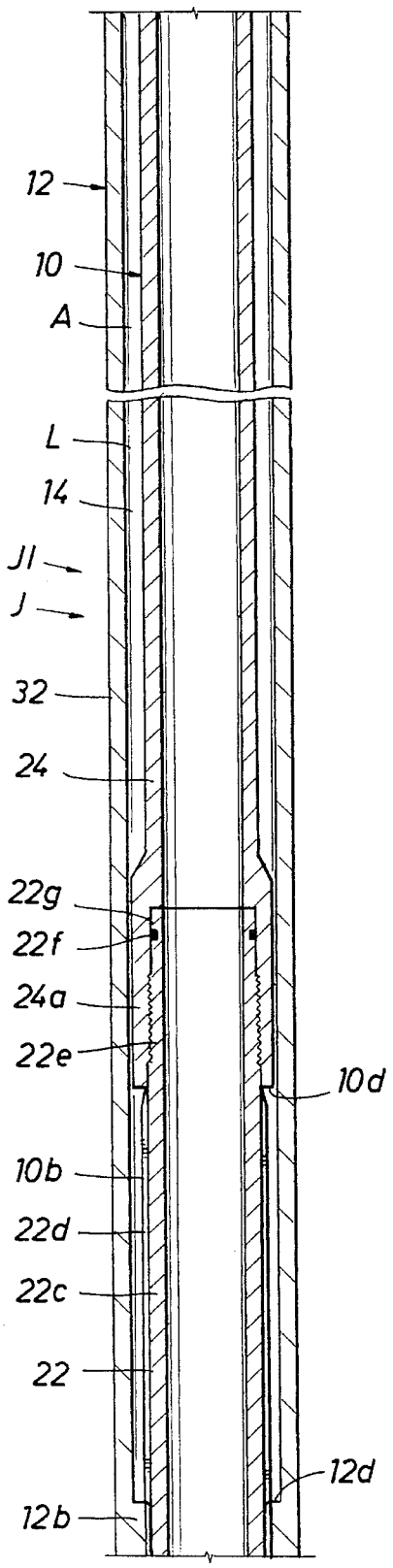
Figure 3D:
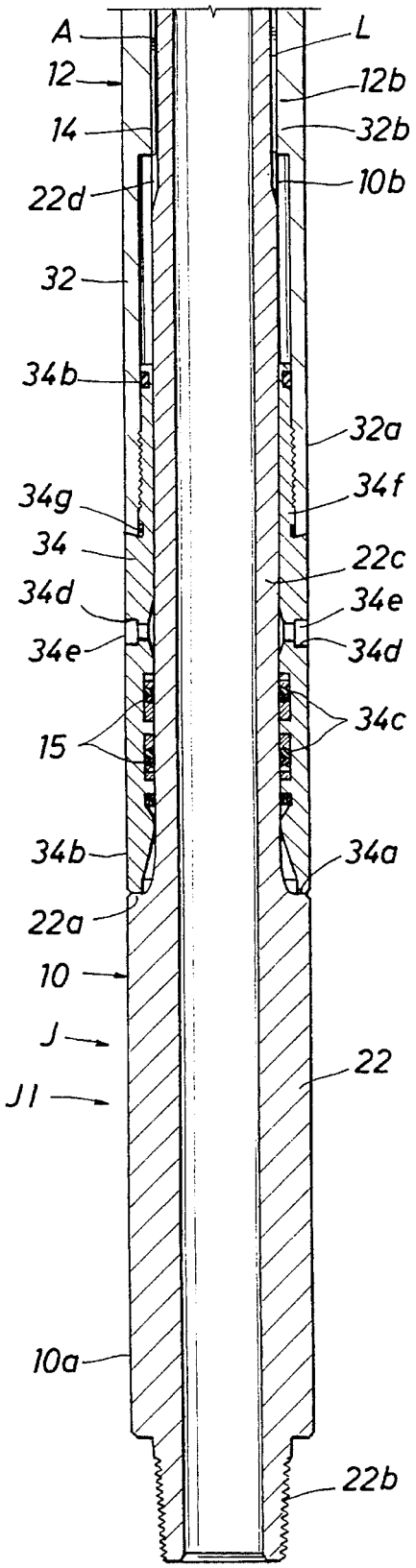

As shown in FIGS. 1, 2 and 3C, the inner and outer cylindrical assemblies 10 and 12, respectively, include interfering stop faces 10*d* and 12*d*, respectively, which limit the maximum extension of the well jar accelerator J and prevent disengagement of the inner and outer cylindrical assemblies 10 and 12.

In order to describe in greater detail the make-up and assembly of the well jar accelerator J of the present invention, the following discussion will be specifically with reference to FIGS. 3A–3D pertaining to the "up" well jar accelerator J1. It is to be understood that similar details would be applicable in the make-up and assembly of the "down" well jar accelerator J2 and that one skilled in the art would be able to employ the detailed discussion as pertaining to the "up" well jar accelerator to the "down" well jar accelerator J2 as schematically shown in FIG. 2.

Referring to FIGS. 3C and 3D, the inner and outer cylindrical assemblies 10, 12 are provided with spline portions 10*b* and 12*b*, respectively, which engage each other in a rotational interference fit to transfer rotational driving forces developed during normal drilling or fishing operations from one cylindrical assembly to another. Preferably, the spline portions 10*b*, 12*a* are disposed within the main liquid chamber 14 and are thus continuously bathed in the synthetic silicone liquid contained therein. Thus, friction developed during movement of the parts relative to each other is greatly reduced.

In the well jar accelerators J1 and J2, both the inner and outer cylindrical assemblies 10, 12 may be formed in one or more sections which are threaded or otherwise coupled together for convenience in manufacture, assembly, repair, and the like. As stated above, it is to be understood that the following detailed discussion of the "up" well jar accelerator J1 is intended to disclose a preferred assembly of the "up" well jar accelerator J1 and a similar type of assembly is envisioned for the "down" well jar accelerator J2.

As illustrated in FIGS. 3A–3D, the inner cylindrical assembly 10 of the "up" well jar accelerator J1 is preferably made up of a mandrel 22 (FIGS. 3C–3D), a mandrel extension 24 (FIGS. 3B–3C), and a washpipe 26 (FIGS. 3A–3B).

The outer cylindrical assembly 12 of the "up" well jar accelerator J1 is made up of a top sub 28 (FIG. 3A), a pressure body 30 (FIGS. 3A–3B), a connector body 31 (FIG. 3B), a spline body 32 (FIGS. 3B–3D), and a mandrel body 34 (FIG. 3D), all of which have substantially equal external diameters.

Referring to FIG. 3D, the mandrel 22 is partially disposed within and moves longitudinally relative to the mandrel body 34, the lower seal means 15, and the spline body 32, and has a lower end portion 10*a* disposed exterior thereto below the mandrel body 34. The lower end portion 10*a* has an external diameter substantially the same as the sections of the outer cylindrical assembly 12. Referring to FIG. 3D, the lower end portion 10*a* has an upwardly facing annular shoulder 22*a* which contacts a downwardly facing annular surface 34*a* provided by a lower end 34*b* of the mandrel body 34 when the inner and outer cylindrical assemblies 10, 12 are in the unloaded or non-tensioned position.

Referring to FIG. 3D, the lower end 10*a* of the mandrel 22 includes an externally threaded pin 22*b* for threaded connection with an internally threaded box of the upper end of the concentrated mass or the well jar or a lower portion of the bottom hole assembly including the well jar. Similarly, the top sub 28 of the outer cylindrical assembly 12 has an internally threaded box 28*a* at its upper end 12*a* adapted for connection with a pin typically of a lower end of the running string.

Referring to FIGS. 3C–3D, a main body portion 22*c* of the mandrel 22 is disposed within the outer cylindrical assembly 12 and has an outer diameter slightly smaller than the inner diameter of the mandrel body 34 and the spline body 32. A plurality of inwardly facing female spline grooves 22*d* are provided on the mandrel 22 which extend longitudinally from about its midportion to about its upper end to form the above-mentioned spline portion 10*b*. Preferably, the external diameter of the spline portion 10*b* is slightly less than the main body portion 12*a* of the outer cylindrical assembly 12. This allows the synthetic silicone liquid in the main liquid chamber 14 to flow through the spline portion of the well jar accelerator J during operation.

Referring to FIG. 3C, the upper end of the mandrel 22 has external threads 22*e* which are connected to the internal threads 24*a* at the lower end of the mandrel extension 24. The connection between the members 22, 24 includes an O-ring seal 22*f* received in an annular groove 22*g* in the upper end of the mandrel 22.

The mandrel extension 24 has an outer diameter less than the inner diameter of the pressure body 30, the connector body 31, and the spline body 32 as shown in FIGS. 3B–3C. The mandrel extension 24 has an upper portion 24*b* having a piston assembly P mounted thereon (FIG. 3B), as will be more fully explained below. An upper end 24*c* of the mandrel extension 24 is externally threaded and connected with the lower end 26*a* of the washpipe 26. The connection between the members 24, 26 includes an O-ring seal 26*c* received in an annular groove 26*d* in the lower end of the washpipe 26. The seal 26*c* engages the outer surface of the mandrel extension 24 to form a fluid-tight seal therebetween.

Referring to FIG. 3A, the washpipe 26 includes an upper portion 26*b* having an outer diameter slightly smaller than the inner diameter of the top sub 28. The washpipe 26 slidably engages the top sub 28.

Referring to FIG. 3D, the mandrel body 34 of the outer cylindrical assembly 12 includes a pair of annular internal grooves 34*c* which receive the lower seal means 15 to form a slidably engaging fluid-tight seal with the mandrel 22. The lower seal means 15 defines the lower end of the main liquid chamber 14 and may be of any suitable sealing means. The mandrel body 34 also has at least one opening 34*d* communicating with the main liquid chamber 14 for filling the combined liquid chamber L with the synthetic silicone liquid. Each opening 34*d* is adapted to receive a threaded fill plug 34*e*.

Referring to FIG. 3D, the upper end 34*f* of the mandrel body 34 is externally threaded and connected with the internally threaded lower end 32*a* of the spline body 32. The spline body 32 is provided with a plurality of inwardly projecting male splines 32*b* which extend longitudinally forming the outer cylindrical assembly spline portion 12*b*. The male splines 32*b* are adapted for an interference fit with the female spline grooves 22*d*. Rotational driving forces can be transmitted through the spline body 32 to the mandrel 22 by the engagement of the respective male splines 32*b* with the longitudinal female spline grooves 22*d*.

As shown in FIG. 3D, the connection between the mandrel body 34 and the spline body 32 includes an O-ring seal 34*g* and seal means 34*h* to further ensure a fluid-tight connection between the members 34, 32.

Referring to FIG. 3B, the upper end 32*c* of the spline body 32 is internally threaded and connected to the externally threaded lower end 31*a* of the connector body 31. The connection between the spline body 32 and the connector body 31 includes a lower O-ring seal 31*b* and a lower seal means 31*c* to further ensure a fluid-tight connection between the members 32, 31.

Similarly, the upper end 31*d* of the connector body 31 is externally threaded and connected to the internally threaded lower end 30*a* of the pressure body 30. The connection between the connector body 31 and the pressure body 30 includes an upper O-ring seal 31*e* and an upper seal means 31*f* to further ensure a fluid-tight connection between the members 31, 30.

Referring to FIG. 3B, the pressure body 30 includes an opening 30*b* communicating with the expansion liquid chamber 17 for adding liquid thereto. The opening 30*b* is adapted to receive a threaded fill plug 30*c*.

Referring to FIG. 3A, the upper portion 30*d* of the pressure body 30 terminates with an internally threaded upper end portion 30*e*. The internally threaded upper end portion 30*e* is connected to the externally threaded lower end 28*b* of the top sub 28. The connection between the members 28, 30 includes an O-ring seal 28*c* to further ensure a fluid-tight seal between the members 30, 28. As mentioned above, the top sub 28 is adapted for connection with the running string located above the well jar accelerator J.

Referring to FIG. 3B, the piston assembly P is mounted on the upper portion 24*b* of the mandrel extension 24 of the inner cylindrical assembly 10. The piston assembly P is at the upper end of the main liquid chamber 14. The piston assembly P includes the annular piston 40 mounted on the upper portion 24*b* of the mandrel extension 24 for limited longitudinal movement relative thereto. The longitudinal movement of the annular piston 40 relative to the mandrel extension 24 is limited downwardly by one or more ears 24*d* extending from the outer surface of the mandrel extension 24 and is limited upwardly by a tapered shoulder 30*f* as shown in FIGS. 3B, 4 and 5.

Referring to FIGS. 4 and 5, the annular piston 40 has an annular recess 40*a* in the lower portion 40*b* of the annular piston 40. The annular recess 40*a* receives a piston seal means 42 to form a slidably engaging fluid-tight seal between the pressure body 30 and the annular piston 40. The seal means 42 is held in the annular recess 40*a* by a backup ring 44 and a retaining ring 46 received in a circumferential groove 40*c* in the annular piston 40.

As discussed above, the downward longitudinal movement of the annular piston 40 is limited by the ears 24*d*. As shown in FIG. 5, a lower face 40*d* of the annular piston 40 will abuttingly contact the ears 24*d* when the maximum downward longitudinal movement of the annular piston 40 relative to the mandrel extension 24 is reached. The annular piston 40 has a reduced inside diameter at a bottom end 40*e* and at an upper end 40*f*. The reduced inside diameter is slightly larger than the outer diameter of the mandrel extension 24 to provide a sliding fit therebetween. One or more upper passageways 40*g* (FIGS. 4, 5 and 7) are formed in the upper end 40*f* and one or more lower passageways 40*h* (FIGS. 4 and 5) are formed in the bottom end 40*e* of the annular piston 40. The upper and lower passageways 40*g* and 40*h*, respectively, are in fluid communication with each other via an inner annular area 48 formed between the annular piston 40 and the mandrel extension 24. Thus, fluid communication exists from the main liquid chamber 14 below the annular piston 40 through to the upper end 40*f* of the annular piston 40 via the interior passageways 40*g*, 40*h*, and 48.

Referring to FIGS. 4 and 5, the annular piston 40 has an upper recess 40*i* for receiving a retainer ring 50 and an upper face 40*j* for sealingly contacting a lower surface 16*e* of the seal body 16 during one stage of operation of the well jar accelerator J as will be explained below.

Referring to FIGS. 3B, 4, and 5, the seal body 16 is located at the lower end 26*a* of the washpipe 26. The seal body 16 comprises an annular ring 16*a* which abuts the lower end 26*a* of the washpipe 26. The seal body 16 is held in place with a retainer ring 50 received in an annular groove 24*e* in the mandrel extension 24. The seal body 16 could also be held in place by various other means, as for example, a step on the mandrel extension 24. The seal body 16 includes an internal annular groove 16*b* for receiving a seal means 52 to provide a fluid-tight seal between the seal body 16 and the mandrel extension 24.

The seal body 16 has an outer diameter slightly less than the inner diameter of the pressure body 30 so as to form an annular passageway 16*c* therebetween as shown in FIG. 4. The annular passageway 16*c* extends along the length of the annular ring 16*a* from an upper surface 16*d* to a lower surface 16*e*. As shown in FIGS. 4 and 5, the upper passageways 40*g* and the seal body passageway 16*c* do not vertically intersect with one another for reasons which will be explained below.

In the non-tensioned or unloaded position of the "up" well jar accelerator J1 as shown in FIGS. 1, 3A–3D and 4, the lower surface 16*e* of the seal body 16 is spaced from the upper face 40*j* of the annular piston 40 to form an annular space 54 (FIGS. 1, 3B and 4). In the preferred embodiment of the "up" well jar accelerator J1, the axial distance between the lower surface 16*e* and the upper face 40*j* in the unloaded position is in the range of approximately ⅜ths to ¾ths of an inch. In the unloaded position, liquid in the main liquid chamber 14 is in communication with the expansion liquid chamber 17 by the interior passageways 40*g*, 40*h*, and 48 of the annular piston 40, the annular space 54, and the seal body passageway 16*c* as shown in FIG. 4. Thus, fluid communication exists from the main liquid chamber 14 below the annular piston 40 to the expansion liquid chamber 17 above the seal body 16.

In the tensioned or extended position of the "up" well jar accelerator J1 as shown in FIG. 5, the lower surface 16*e* of the seal body 16 is in abutting contact with the upper face 40*j* of the annular piston 40. In the extended position, the upper face 40*j* of the annular piston 40 seals the seal body passageway 16*c* from the main liquid chamber 14. Additionally or alternatively, the upper passageways 40*g* are sealed from the expansion liquid chamber 17 by the seal body 16 in the extended position. Thus, in the extended position the main liquid chamber 14 is in non-fluid communication with the expansion liquid chamber 17.

As described above, the expansion liquid chamber 17 is defined by the seal body 16 and the expansion sleeve 18 disposed between the inner and outer cylindrical assemblies 10, 12 in sealing engagement therewith and movably spaced longitudinally relative to each other. As shown in FIG. 3A, the expansion sleeve 18 includes a cylindrical sleeve 18*a* having a lower head 18*b* with an internal bore 18*c* therethrough. The internal bore 18*c* has a diameter slightly greater than the external diameter of the washpipe 26. The lower head 18*b* has an external diameter slightly less than the internal diameter of the pressure body 30. The lower head 18*b* includes an annular inner groove 18*d* and an annular outer groove 18*e* for receiving inner and outer seal means 58 and 60, respectively, to provide a sliding, fluid-tight seal between the pressure body 30 and the washpipe 26.

As shown in FIG. 3A, the expansion spring chamber 19 is defined by the expansion sleeve 18 and the upper seal means 20 disposed between the inner and outer cylindrical assemblies 10, 12 in sealing engagement therewith. The expansion spring chamber 19 is a sealed chamber filled with air and a spring means 21, such as a cylindrical helical spring. The lower end of the expansion spring chamber 19 is sealed by the inner and outer seal means 58 and 60 and the lower sleeve head 18*b*. As shown in FIG. 3A, the upper end of the expansion spring chamber 19 is sealed by the upper seal means 20 between the top sub 28 and the washpipe 26. The upper seal means 20 is held in place in an annular recess 28*e* by an annular retaining ring 62. The annular retaining ring 62 threadably engages an internally threaded lower end 28*d* of the top sub 28 and abuts the upper seal means 20. The annular retaining ring 62 has a lower surface 62*a* providing an end contact surface for the upper end 21*a* of the spring means 21. The lower end 21*b* of the spring means 21 is in abutting contact with an upper surface 18*f* of the lower head 18*b* of the expansion sleeve 18.

It is to be understood that liquid pressure acting on the lower head 18*b* of the expansion sleeve 18 in the direction as indicated by the arrows 68 in FIG. 4 will increase the volume of the expansion liquid chamber 17 which is filled with synthetic silicone liquid and will decrease the volume of the expansion spring chamber 19. The liquid pressure acting on the lower head 18*b* is resisted by the spring means 21 and the air-filled expansion spring chamber 19.

Thus, as the volume of synthetic silicone liquid in the main liquid chamber 14 changes as a result of thermal expansion, the added volume of synthetic silicone liquid in the main liquid chamber 14 is permitted to flow into the expansion liquid chamber 17 when the well jar accelerator J is in the unloaded position as shown in FIGS. 1, 2, 3B and 4. The well jar accelerator J automatically maintains a constant volume of liquid in the main liquid chamber 14 and eliminates the possibility of over-pressurization in the main liquid chamber 14. The piston and seal body assembly allows communication between the expansion liquid chamber 17 and the main liquid chamber 14 when the well jar accelerator is in the unloaded position. Furthermore, the spring-loaded expansion spring chamber 19 forces synthetic silicone liquid from the expansion liquid chamber 17 into the main liquid chamber 14 in the event of minor leakage in the main liquid chamber 14.

The "up" well jar accelerator J1 may preferably include a hydrostatic pressure load imbalance to compensate for the weight of the concentrated mass located below the well jar accelerator J1. Referring to FIG. 1, hydrostatic pressure acts on a differential area to retract the "up" well jar accelerator J1. The differential area is formed by the upper seal means 20 and the lower seal means 15. The cross-sectional area of the inner cylindrical assembly 10 in the plane of the upper seal means 20 is less than the cross-sectional area of the inner cylindrical assembly 10 in the plane of the lower seal means 15. The hydrostatic pressure load imbalance yields a closing force on the "up" well jar accelerator J1. The amount of the force varies with the hydrostatic pressure resulting from the mud weight and depth of the "up" well jar accelerator J1. This hydrostatic closing force is used to counteract the weight of the concentrated mass located below the "up" well jar accelerator J1 to make the "up" well jar accelerator J1 more effective as will be explained below.

It is also to be understood that the "up" well jar accelerator J1 according to the present invention as described above but without the hydrostatic pressure load imbalance may also be used in an inverted manner as an "up" well jar accelerator. The "down" well jar accelerator J2 according to the present invention as described above may also be used in an inverted manner as a "down" well jar accelerator.

Operation of the Present Invention

In the operation or use of the well jar accelerator J of the present invention, the lower end 10*a* of the inner cylindrical assembly 10 is connected to the lower portion of the fishing string, preferably just above a concentrated mass such as a string of one or more drill collars. The well jar is preferably located immediately below the concentrated mass and just above the fishing tool or the like which is connected to an object to be jarred. The outer cylindrical assembly 12 is connected at its upper end 12*a* with the lower end of the running string in the "up" jarring operation. In the "down" jarring operation, the outer cylindrical assembly 12 is connected at its upper end 12*a* with the lower end of a concentrated mass connected to the lower end of the running string.

When it is desired to operate the "up" well jar accelerator J1 and "up" well jar combination, the operator on the surface initially connects the fishing tool or like device to the object stuck in the well by conventional techniques. When it is desired to initiate the jarring stroke with the well jar, the operator pulls upwardly on the fishing string at the surface so as to exert an upward pull on the outer cylindrical assembly 12 of the "up" well jar accelerator J1. Inasmuch as the inner cylindrical assembly 10 is connected to lower members which are connected to the stuck object, it remains substantially immobile. A strain is pulled on the running string which causes the "up" well jar accelerator J1 to stroke or telescope. The amount of stroke depends on the size and design of the well jar accelerator J1. Typically, the stroke may be approximately 12 inches.

During the upward telescoping stroke of the "up" well jar accelerator J1, the tapered shoulder 30*f* of the pressure body 30 moves upwardly in the direction of the seal body 16 as shown in FIGS. 4 and 5. The annular piston 40 also moves upwardly with the pressure body 30 due to the friction between the piston seal means 42 and the pressure body 30. However, once the upper face 40*j* of the annular piston 40 abuts the lower surface 16*e* of the seal body, the annular piston 40 will not continue to move upwardly with the pressure body 30. A slidably engaging fluid-tight seal between the pressure body 30 and the annular piston 40 is formed by the piston seal means 42.

As shown in FIG. 5, the upper passageways 40*g* in the annular piston 40 are sealed or closed off by the lower surface 16*e* of the seal body 16 when the upper face 40*j* abuts the lower surface 16*e* of the seal body 16. As the "up" well jar accelerator J1 continues to stroke upward, the synthetic silicone liquid in the main liquid chamber 14 is compressed which results in energy being stored in the "up" well jar accelerator J1. As continued strain is pulled on the running string, the stored energy in the "up" well jar accelerator J1 will cause the well jar to operate as described in the above section "BACKGROUND OF THE INVENTION."

The "down" well jar accelerator J2 of FIG. 2 operates in a similar manner. When it is desired to operate the "down" well jar accelerator J2 and "down" well jar combination, the operator on the surface initially connects the fishing tool or like device to the object stuck in the well by conventional techniques. When it is desired to initiate the jarring stroke with the well jar, the operator lowers or pushes downwardly on the fishing string at the surface so as to exert a downward force on the outer cylindrical assembly 12 of the "down" well jar accelerator J2. Inasmuch as the inner cylindrical assembly 10 is connected to lower members which are connected to the stuck object, it remains substantially immobile. The downward force acting on the "down" well jar accelerator J2 causes the "down" well jar accelerator J2 to compressively stroke. The amount of stroke depends on the size and design of the well jar accelerator J2. Typically, the stroke may be approximately 12 inches.

During the compression stroke of the "down" well jar accelerator J2, the seal body 16 moves downwardly with the outer cylindrical assembly 12. Once the lower surface 16*e* of the seal body 16 abuts the upper face 40*j* of the annular piston 40, the annular piston 40 will begin to move downwardly with the outer cylindrical assembly 12 and the seal body 16. A slidably engaging fluid-tight seal between the inner cylindrical assembly 10 and the annular piston 40 is formed by the piston seal means 42.

The passageways 40*p* in the annular piston 40 are sealed or closed off by the lower surface 16*e* of the seal body 16 when the lower surface 16*e* of the seal body 16 abuts the upper face 40*j*. As the "down" well jar accelerator J2 continues its compression stroke, the synthetic silicone liquid in the main liquid chamber 14 is compressed which results in energy being stored in the "down" well jar accelerator J2. As continued downward force is applied, the stored energy in the "down" well jar accelerator J2 will cause the well jar to operate as described in the above section "BACKGROUND OF THE INVENTION."

It is to be understood that the well jar "free" stroke is less than the total stroke of the well jar accelerator J. When the well jar trips, the well jar accelerator J imparts its stored energy to the well jar and the concentrated mass (typically, drill collars) between the well jar and well jar accelerator, in the form of acceleration, causing the well jar to strike a blow of very high impact value. Theoretically, in a hypothetical situation where the stretch of the running string is negated, during the jarring stroke of the "up" well jar with the "up" well jar accelerator J1, the inner cylindrical assembly 10 moves upwardly relative to the outer cylindrical assembly 12 which increases the volume of the main liquid chamber 14 and releases the stored energy therein. If such jarring blow does not immediately release the stuck object, the running string is then slacked off or lowered again whereby the well jar and well jar accelerator return to their initial positions to begin another cycle.

In the hypothetical situation where the compression of the running string is negated, during the jarring stroke of the "down" well jar with the "down" well jar accelerator J2, the inner cylindrical assembly 10 of the "down" well jar accelerator J2 moves downwardly relative to the outer cylindrical assembly 12 which increases the volume of the main liquid chamber 14 and releases the stored energy therein. If such jarring blow does not immediately release the stuck object, the running string is then pulled or raised whereby the well jar and well jar accelerator return to their initial positions to begin another cycle.

As hereinbefore described, in the unloaded or retracted position of the "up" well jar accelerator J1 as shown in FIGS. 1, 3A–3D, and 4, excessive pressure in the main liquid chamber 14 due to thermal expansion is relieved through the piston passageways 40*p* (FIGS. 1 and 4) or 40*g*, 40*h*, and 48 (FIG. 4), the annular space 54, and the seal body passageway 16*c* into the expansion liquid chamber 17. The expansion liquid chamber will expand causing the expansion spring chamber 19 to retract.

As stated above, the spring-loaded expansion spring chamber 19 forces synthetic silicone liquid from the expansion liquid chamber 17 into the main liquid chamber 14 in the event of minor leakage in the main liquid chamber 14. The liquid compensation feature is accomplished by filling the combined liquid chamber L at the fill plug opening 30*b* with the expansion sleeve 18 in a retracted position. This is accomplished by filling prior to assembling the top sub 20. The fill plug 30*c* is installed in the fill plug opening 30*b* after the synthetic silicone liquid has been added. During filling, the fill plug 34*e* is removed from opening 34*d* to allow removal of air. The fill plug 34*e* is installed after filling is completed. The spring means 21 is compressed as the top sub 28 is fully threaded onto the pressure body 30. Thus, if a leak occurs at any of the seal means or otherwise in the main liquid chamber 14, the spring force will replenish synthetic silicone liquid in the main liquid chamber 14.

The following description will help to better explain the advantages of the hydrostatic pressure load imbalance when incorporated into the "up" well jar accelerator J1. As above described, hydrostatic pressure acts on a differential area to close the "up" well jar accelerator J1. The hydrostatic force varies with the hydrostatic pressure. The hydrostatic force counteracts the weight of the mass below the "up" well jar accelerator J1 to make the "up" well jar accelerator J1 more effective. Thus, if the "up" well jar accelerator J1 is provided with a hydrostatic pressure load imbalance resulting from the differential area, the "up" well jar accelerator J1 at a given depth will have a hydraulic closing force of a determinable amount and this determinable closing force amount will have to be exceeded prior to the "up" well jar accelerator J1 telescoping out. This means that if an "up" well jar accelerator J1 has 25,000 pounds of hydrostatic closing force in a given situation, the first 25,000 pounds of tensile force applied to the "up" well jar accelerator J1 will be offset by the hydrostatic closing force and the "up" well jar accelerator will remain in its closed or unloaded position. If the weight of the concentrated mass below the "up" well jar accelerator J1 is 25,000 pounds, then the hydrostatic closing force would equal the weight of the concentrated mass and the amount of fluid force in the "up" well jar accelerator J1 would approximate the load applied to the well jar.

The foregoing disclosure and description of the invention is illustrative and explanatory thereof, and various changes in the size, shape, and materials, as well as in the details of illustrative construction and assembly, may be made without departing from the spirit of the invention.

We claim:

1. A well jar accelerator comprising:

inner and outer telescopingly related cylindrical assemblies movable longitudinally relative to one another, said inner and outer cylindrical assemblies having telescopically overlapping portions providing an annular space therebetween, said annular space having upper and lower ends;

first annular means for sealing disposed between said inner and outer cylindrical assemblies proximate said lower end of said annular space of said overlapping portions;

second annular means for sealing disposed between said inner and outer cylindrical assemblies proximate said upper end of said annular space of said overlapping portions;

a sealable expansion sleeve disposed between said inner and outer cylindrical assemblies and between said first and second annular sealing means defining an annular liquid chamber between said first annular sealing means and said expansion sleeve and an annular compensating chamber between said expansion sleeve and said second annular sealing means;

means for operatively segregating said annular liquid chamber into a first chamber and a second chamber, said first and second chambers being in fluid communication when said inner and outer cylindrical assemblies are in an unloaded position and said first and second chambers being sealably segregated when said inner and outer cylindrical assemblies are in a loaded position; and means for maintaining a predetermined non-atmospheric force on said expansion sleeve in the direction of said annular liquid chamber.

2. The well jar accelerator according to claim 1, wherein said means for maintaining a non-atmospheric force on said expansion sleeve introduces a minimal non-hydrostatic operating pressure in said annular liquid chamber.

3. The well jar accelerator according to claim 1, wherein said means for maintaining a non-atmospheric force comprises a spring in compression supported in spaced relationship within said compensating chamber.

4. The well jar accelerator according to claim 1, wherein one end of said annular cylindrical assembly includes a threaded connection and one end of said outer cylindrical assembly includes a threaded connection enabling the engagement of said inner and outer cylindrical assemblies with other tubular members.

5. The well jar accelerator according to claim 1, wherein said inner and outer telescoping related cylindrical assemblies include means for enabling rotational transfer from one of said cylindrical assemblies to the other of said cylindrical assemblies.

6. The well jar accelerator according to claim 5, wherein said means for enabling rotational transfer comprises engagable spline members provided on said inner and outer cylindrical assemblies.

7. The well jar accelerator according to claim 1, wherein said annular compensating chamber serves to balance pressure between said annular liquid chamber and said annular compensating chamber.

8. The well jar accelerator according to claim 1, wherein said annular compensating chamber serves to compensate for volumetric changes between said annular liquid chamber and said annular compensating chamber.

9. A well jar accelerator comprising:

inner and outer telescopingly related cylindrical assemblies movable longitudinally relative to one another, said inner and outer cylindrical assemblies having telescopically overlapping portions providing an annular space therebetween, said annular space having upper and lower ends;

first annular means for sealing disposed between said inner and outer cylindrical assemblies proximate said lower end of said annular space of said overlapping portions;

second annular means for sealing disposed between said inner and outer cylindrical assemblies proximate said upper end of said annular space of said overlapping portions;

a sealable expansion sleeve disposed between said inner and outer cylindrical assemblies and between said first and second annular sealing means defining an annular liquid chamber between said first annular sealing means and said expansion sleeve and an annular compensating chamber between said expansion sleeve and said second annular sealing means;

means for operatively segregating said annular liquid chamber into a first chamber and a second chamber, said first and second chambers being in fluid communication when said inner and outer cylindrical assemblies are in an unloaded position and said first and second chambers being sealably segregated when said inner and outer cylindrical assemblies are in a loaded position, said means for operatively segregating said annular liquid chamber comprising:

an annular seal body disposed between said inner and outer cylindrical assemblies in the annular liquid chamber, said seal body is attached to one of said cylindrical assemblies and has a first end surface; and an annular piston disposed between said inner and outer cylindrical assemblies in the annular liquid chamber, said piston having a first end surface capable of contacting said first end surface of said seal body such that the first and second liquid chambers are in non-fluid communication with each other; and means for maintaining a predetermined non-atmospheric force on said expansion sleeve in the direction of said annular liquid chamber.

10. The well jar accelerator of claim 9, wherein said annular liquid chamber confines operating fluid, wherein said seal body has a second end surface opposite said first end surface of said seal body and a first fluid passageway is provided to permit operating fluid to pass from one to the other of said end surfaces of said seal body, wherein a second fluid passageway is provided to permit operating fluid to pass through or around said piston, and wherein said first and second fluid passageways are in fluid communication with one another in the unloaded position and said first and second fluid passageways are in non-fluid communication when in the loaded position.

11. The well jar accelerator of claim 9, further comprising:

an inner seal disposed between said seal body and said inner cylindrical assembly; and an outer seal disposed between said piston and said outer cylindrical assembly.

12. The well jar accelerator of claim 9, wherein said piston is in slidable engagement with said inner and outer cylindrical assemblies.

13. The well jar accelerator of claim 9, wherein said outer cylindrical assembly includes a means for limiting the longitudinal movement of said piston towards said seal body such that said seal body and said piston are in non-contacting relationship with each other when said inner and outer cylindrical assemblies are in the unloaded position.

14. A well jar accelerator comprising:

inner and outer telescopingly related cylindrical assemblies movable longitudinally relative to one another, said inner and outer cylindrical assemblies having telescopically overlapping portions providing an annular space therebetween, said annular space having upper and lower ends, said outer cylindrical assembly having a stop face;

first annular means for sealing disposed between said inner and outer cylindrical assemblies proximate said lower end of said annular space of said overlapping portions;

second annular means for sealing disposed between said inner and outer cylindrical assemblies proximate said upper end of said annular space of said overlapping portions;

a sealable expansion sleeve disposed between said inner and outer cylindrical assemblies and between said first and second annular sealing means defining an annular liquid chamber between said first annular sealing means and said expansion sleeve and an annular compensating chamber between said expansion sleeve and said second annular sealing means;

means for operatively segregating said annular liquid chamber into a first chamber and a second chamber, said first and second chambers being in fluid communication when said inner and outer cylindrical assemblies are in an unloaded position and said first and second chambers being sealably segregated when said inner and outer cylindrical assemblies are in a loaded position; and means for maintaining a predetermined non-atmospheric force on said expansion sleeve in the direction of said annular liquid chamber, said means for maintaining a non-atmospheric force comprising:

a spring having a first end bearing against said stop face and a second end bearing against said expansion sleeve, wherein said expansion sleeve is capable of sliding longitudinally between said inner and outer cylindrical assemblies with said spring providing resistance in the direction of said stop face.

15. A well jar accelerator comprising:

inner and outer telescopingly related cylindrical assemblies movable longitudinally relative to one another, said inner and outer cylindrical assemblies having telescopically overlapping portions providing an annular space therebetween, said annular space having upper and lower ends;

first annular means for sealing disposed between said inner and outer cylindrical assemblies proximate said lower end of said annular space of said overlapping portions;

second annular means for sealing disposed between said inner and outer cylindrical assemblies proximate said upper end of said annular space of said overlapping portions;

a sealable expansion sleeve disposed between said inner and outer cylindrical assemblies and between said first and second annular sealing means defining an annular liquid chamber between said first annular sealing means and said expansion sleeve and an annular pressure compensating chamber between said expansion sleeve and said second annular sealing means;

means for operatively segregating said annular liquid chamber into a first chamber and a second chamber, said first and second chambers being in fluid communication when said inner and outer cylindrical assemblies are in an unloaded position and said first and second chambers being sealably segregated when said inner and outer cylindrical assemblies are in a loaded position; and means for maintaining a predetermined non-atmospheric force on said expansion sleeve in the direction of said annular liquid chamber.

16. The well jar accelerator according to claim 15, wherein said means for maintaining a non-atmospheric force on said expansion sleeve introduces a minimal non-hydrostatic operating pressure in said annular liquid chamber.

17. The well jar accelerator according to claim 15, wherein said means for maintaining a non-atmospheric force comprises a spring in compression supported in spaced relationship within said compensating chamber.

18. The well jar accelerator according to claim 15, wherein one end of said annular cylindrical assembly includes a threaded connection and one end of said outer cylindrical assembly includes a threaded connection enabling the engagement of said inner and outer cylindrical assemblies with other tubular members.

19. The well jar accelerator according to claim 15, wherein said inner and outer telescoping related cylindrical assemblies include means for enabling rotational transfer from one of said cylindrical assemblies to the other said cylindrical assembly.

20. The well jar accelerator according to claim 19, wherein said means for enabling rotational transfer comprises engagable spline members provided on said inner and outer cylindrical assemblies.

21. A well jar accelerator comprising:

inner and outer telescopingly related cylindrical assemblies movable longitudinally relative to one another, said inner and outer cylindrical assemblies having telescopically overlapping portions providing an annular space therebetween, said annular space having upper and lower ends;

first annular means for sealing disposed between said inner and outer cylindrical assemblies proximate said lower end of said annular space of said overlapping portions;

second annular means for sealing disposed between said inner and outer cylindrical assemblies proximate said upper end of said annular space of said overlapping portions;

a sealable expansion sleeve disposed between said inner and outer cylindrical assemblies and between said first and second annular sealing means defining an annular liquid chamber between said first annular sealing means and said expansion sleeve and an annular volumetric compensating chamber between said expansion sleeve and said second annular sealing means;

means for operatively segregating said annular liquid chamber into a first chamber and a second chamber, said first and second chambers being in fluid communication when said inner and outer cylindrical assemblies are in an unloaded position and said first and second chambers being sealably segregated when said inner and outer cylindrical assemblies are in a loaded position; and means for maintaining a predetermined non-atmospheric force on said expansion sleeve in the direction of said annular liquid chamber.

22. The well jar accelerator according to claim 21, wherein said means for maintaining a non-atmospheric force on said expansion sleeve introduces a minimal non-hydrostatic operating pressure in said annular liquid chamber.

23. The well jar accelerator according to claim 21, wherein said means for maintaining a non-atmospheric force comprises a spring in compression supported in spaced relationship within said compensating chamber.

24. The well jar accelerator according to claim 21, wherein one end of said annular cylindrical assembly includes a threaded connection and one end of said outer cylindrical assembly includes a threaded connection enabling the engagement of said inner and outer cylindrical assemblies with other tubular members.

25. The well jar accelerator according to claim 21, wherein said inner and outer telescoping related cylindrical assemblies include means for enabling rotational transfer from one of said cylindrical assemblies to the other said cylindrical assembly.

26. The well jar accelerator according to claim 25, wherein said means for enabling rotational transfer comprises engagable spline members provided on said inner and outer cylindrical assemblies.

* * * * *